US008448570B1

(12) United States Patent
Turner

(10) Patent No.: US 8,448,570 B1
(45) Date of Patent: May 28, 2013

(54) PORTABLE ELECTRIC CAN CRUSHER

(71) Applicant: John A. Turner, Dallas, TX (US)

(72) Inventor: John A. Turner, Dallas, TX (US)

( * ) Notice: Subject to any disclaimer, the term of this patent is extended or adjusted under 35 U.S.C. 154(b) by 0 days.

(21) Appl. No.: 13/655,904

(22) Filed: Oct. 19, 2012

(51) Int. Cl.
*B30B 1/26* (2006.01)
*B30B 9/32* (2006.01)

(52) U.S. Cl.
USPC ..... 100/49; 100/216; 100/292; 100/902; 100/137

(58) Field of Classification Search
USPC ..... 100/45, 49, 902, 137, 215, 216, 282, 100/291, 292
See application file for complete search history.

(56) References Cited

U.S. PATENT DOCUMENTS

| | | | | |
|---|---|---|---|---|
| 3,960,070 | A * | 6/1976 | McClure et al. | 100/49 |
| 5,121,685 | A | 6/1992 | Turner | |
| 5,327,822 | A * | 7/1994 | Koenig | 100/45 |
| 5,507,222 | A | 4/1996 | Reavey | |
| 5,941,167 | A | 8/1999 | Fleming | |
| 5,967,029 | A * | 10/1999 | Mayo | 100/99 |
| 6,170,118 | B1 | 1/2001 | McIntyre et al. | |
| 7,089,853 | B1 | 8/2006 | Diekleman | |
| 7,552,676 | B1 * | 6/2009 | Johnson | 100/289 |
| 2002/0100376 | A1 | 8/2002 | Schell et al. | |
| 2005/0126405 | A1 * | 6/2005 | Imperato | 100/240 |
| 2011/0192294 | A1 | 8/2011 | Salisbury | |
| 2011/0259693 | A1 * | 10/2011 | Nascarella | 190/18 A |

* cited by examiner

*Primary Examiner* — Jimmy T Nguyen
(74) *Attorney, Agent, or Firm* — Carl F. Melito

(57) ABSTRACT

A portable electric can crusher is disclosed that crushes cans, at the "point of collection". The can crusher crushes cans into a crushed relationship wherein the upper and lower circular end faces are generally unaltered and aligned in a co-planar position, the crushed pattern accomplished by the result of placing the can in a perpendicular position adjacent a ram plate and an elongated rectangular crushing plate which is used for creasing a center portion of the can followed by moving the ram plate against the can into contact with a rigid vertical wall. The crushing motions of the crusher are achieved through dual cam and slot means cooperatively drivably connected to a force transfer block which imparts a predetermined relation translation motion of the plates in response to rotation of the transfer block. A high powered rechargeable battery provides the force necessary to crush cans faster and more productively.

10 Claims, 7 Drawing Sheets

PORTABLE ELECTRIC CAN CRUSHER

BACKGROUND OF THE INVENTION

The use of aluminum and other metal cans has greatly increased within the last forty years worldwide, particularly for canned foods and juices, milk, soft drinks, and beer. The employment of thinner aluminum and other metals in the manufacture of these cans has met with considerable success and the employment of aluminum has enabled every manufacturer of cans to provide an easy opening tab at one end thereof which may be easily manipulated to form an opening in the can and making it easier to crush and recycle. Also, for shipping purposes, all cans are now required to be much lighter than the older cans to keep shipping costs down. The employment of aluminum and other metals in the manufacture of cans has increased the cost of manufacture due to the increasing cost of these materials over time as well. Therefore, recycling of empty cans is an established element of commerce which not only enables more efficient allocation of these natural resources, but it also benefits the environment by removing cans from beaches, campsites, and the highways and byways by providing free enterprise an incentive to recycle because of the inherent industrial value of these raw materials worldwide.

Many prior art devices exist that crush empty cans "in doors", such as in restaurants, bars and in homes. None however have yet been improved to capitalize on new technologies such as lighter and stronger materials, and light and powerful lithium ion batteries to crush cans in the "out doors", or in trucks, cars, planes, trains, etc. Truckers, campers and hikers simply pack trash bags, or use campsite or other trash facilities to dispose of their cans. Nor has any invention in the prior art dealt with the productivity problem of transporting bulky "non-crushed cans" to sites where the cans are crushed in bulk. Historically, the focus has been on crushing the cans in the most efficient way possible in terms of cost and manpower so that can remnants take up less space in a garbage bag or a box until the cans are disposed of permanently, generally in a landfill. However, in recent years widespread concern about the environment has led to the enactment of popularly called "bottle bills" which require manufacturers of soft drinks and beer to charge a deposit on cans as well as other beverage containers such as bottles, so as to encourage the purchasers to return the empty containers to the store rather than discard these containers at the expense of the environment. The "trash problem" is especially bad in fast growing places around the globe like Southeast Asia, where the trash from their beaches reach the North Pacific coast of the United States and elsewhere. Parallel to this method of encouraging recycling of cans, recycling centers have become part of every day life in almost every community where metal cans are used in commerce. A need exists for a light weight apparatus and method by which all metal cans can be crushed quickly at the "point of collection", anywhere, to enhance the productivity and incentive for private handling, storage and transport of metal containers.

Return deposits and cash paid per pound for recycled aluminum and other metals at worldwide recycling centers encourage the world's population in general to avoid littering and to make an effort to deposit these materials into the trash which eventually winds up in solid waste disposal systems including landfills. Both the recycle and "return deposit" methods assist in the preservation of natural resources by encouraging manufacturers of beverage containers to reuse containers or to recycle these materials. Beverage containers, especially aluminum beverage containers, are frequently discarded in public places, which are "out doors". Higher productivity in the ease of transport and storage of such materials would provide further incentive to encourage governments, individuals and private enterprise to collect cans from public places, campsites and landfills, including the streets, highways and parks.

The so-called "bottle bills" have caused a number of storage and transportation problems. For example, empty cans take up an unreasonable amount of space in handling and shipping. The expanded space requirements of storage and handling of these cans creates inconveniences and substantial overhead expenses which in many cases nullify the recycle value. Unlike bottles which may be sterilized and refilled, empty cans must eventually be crushed and their component materials recycled. It is desirable, since cans are safer, more compact, lighter and easier to store when crushed, to further encourage the use of cans by providing improved devices and methods for "out door" uses which can fold and crush these empty cans at the "point of collection" so that their volume density takes up a fraction of their previous occupied space before transport. Merely crushing the cans, however, in a conventional fashion simply will not suffice. Many states have no statutory deposit requirements, and yet the bottlers use essentially the same designs on their cans across state lines. To avoid fraud, therefore, the cans must be identifiable as deposit cans. Furthermore, the trademark on the side of the can must be identifiable so that the can will be returned to the proper supplier. Once cans have been crushed by various prior art crushing devices which flatten the cans in a plane through the longitudinal axis, the written material on the sides of the cans are unreadable. In other aspects the faces, i.e., the circular end face of the can, generally contain the deposit information on the upper face. Most can crushing operations squeeze the two end faces of the can toward each other. This is just as unsatisfactory for purposes of the "bottle bill" concept because, after the operation is complete, the cylindrical wall is entirely obscured, and identification of the source is impossible.

Other prior art devices have provided crushed cans while preserving the relevant printed material. In these crushers, the can is creased at the center of the cylindrical wall either prior to or during the crushing operation. However, in most of the embodiments disclosed, two separate manual operations are required, the first to crease the can and the second to complete the fold of the can. In other embodiments the creasing element is never fully retracted during the crushing operation and thus the printed matter on the end faces of the can is partly obstructed.

Several references exist which describe apparatus for laterally crushing cans as opposed to crushing in an end to end matter. In this regard U.S. Pat. No. 3,832,941, issued to Bynumw Moller and U.S. Pat. No. 4,291,618, issued to Warren R. Heiser et al. present apparatus and methodology for crushing cans by first laterally compressing the central portion of the can to inwardly tilt the can's opposite ends, and then further flattening the can by further tilting the can ends until they lie in generally the same plane and parallel to the flattened can body. In this regard the can crushing sequence of the Moller reference provides a center crushing element which is pushed through a slot in a stationary plate to laterally flatten the center portion of the can against a movable plate. The crushing element is then withdrawn and the movable plate is moved to flatten the can against the stationary plate. The flattened can is then dropped through a slot thus removing the can from the apparatus. A similar crushing sequence is presented in the Heiser et al. reference where a plunger is moved forward through a slot in a movable plate to crush a central portion of a can. The plunger is then withdrawn and the movable plate is moved to complete the lateral crushing of the can which is then dropped through an opening.

U.S. Pat. No. 5,121,685, issued to Turner in June 1992 solved many of the problems inherent in the prior art and satisfied the need at that time for an improved can crushing apparatus for use "in doors" (i.e. in the home, commercial establishments, and the like). Turner was fully automated and possessed "safety" features, while providing a can crusher wherein the moving plates defined unilateral motion. Turner was special because it avoided moving the plates in opposite directions, thus contributing to a more efficient process requiring less power than its predecessors. As a result, Turner was capable of being downsized for safe general use "in doors". However, Turner was slow in operation and too big and heavy to carry around for general use "out doors".

A need now exists for an improved, more efficient, can crushing apparatus to further incentivize recycling for use at the "point of collection", whether it is "out doors" in nature, or in a truck, car, plane or boat; or even "in doors" such as in the home and in commercial establishments. In short, a portable electric can crusher is needed, and to be effective, it must be light enough to carry around by hand or within a back pack, and powerful enough to crush any can, anywhere. Such a need can be served by an apparatus which is fully automated for crushing cans along with possessing safety features like Turner, and which also provides a light but powerful crushing capability to get more cans recycled per unit time. In another aspect an apparatus is needed which can provide a can crushing capability for high volume use, anywhere, even at a landfill. Thus, one of the many objects of the invention is to provide a portable electric can crusher which may be of such simple and light construction that it is easy to carry so as to be economically feasible, long lasting and relatively trouble free in operation, and so that the enhanced productivity of such an improved device will be a further incentive to recycle.

SUMMARY OF THE INVENTION

A portable electric can crusher is presented that quickly crushes and stores any can, anywhere Like Turner of the prior art, the improved can crusher crushes cans into a crushed relationship wherein the upper and lower circular end faces are generally unaltered and aligned in a co-planar position, the crushed pattern accomplished by the result of placing the can in a perpendicular position adjacent a ram plate and an elongated rectangular crushing plate which is used for creasing a center portion of the can followed by moving the ram plate against the can into contact with a rigid vertical wall. The crushing motions of the crusher are achieved through dual cam and slot means cooperatively drivably connected to a force transfer block which imparts a predetermined relation translation motion of the plates in response to rotation of the transfer block. A high powered, but light, rechargeable battery provides the force necessary to crush cans faster and thus more productively at the "point of collection", so that more cans can be collected and crushed per unit of time. Because lithium ion batteries are much lighter, longer lasting, and more powerful per unit volume than their lead and nickel counterparts, rechargeable lithium ion batteries are the preferred power source.

Unlike Turner of the prior art, the improved can crusher has a handle formed on the top of the housing for carrying the device by hand, and a support enclosure such as a storage bin or back pack attached to the bottom of the housing for temporarily storing the crushed cans prior to unloading. The heaviest part of the prior art, namely the T shaped structure of Turner, has been replaced with a vertical wall which now can be directly attached to the motor gear box assembly. As a consequence, a single guide may be used, rather than the two used in Turner, made possible by the shortened and lighter construction occasioned by replacing the heavier T shaped structure. The gearbox assembly is generally rectangular and can now be made part of a "virtual wall" casting or mold of the vertical wall, or attached to it with nuts and bolts, thus making the vertical wall as rigid, but much lighter and having a shorter length, and thus quicker crushing action. This alteration not only serves to shorten the entire length of the device, but since the entire horizontal portion of the "T" support structure of the prior art Turner device has now been eliminated, the weight of the device is reduced roughly by half, making it lighter for carrying long distances by humans, without losing strength and durability.

The many objects and advantages of the present invention will become apparent to those skilled in the art when the following description of the invention and its various embodiments are reviewed in accompaniment with the attached drawings wherein like reference numerals refer to like components throughout. The previously described embodiments of the present invention have many advantages. Although the present invention will be described in considerable detail with reference to certain preferred embodiments thereof, other alternative embodiments are possible. Therefore, the spirit and scope of the claims should not be limited to the description of the preferred embodiments, nor the alternative embodiments, contained herein.

BRIEF DESCRIPTION OF THE DRAWINGS

FIG. 4 presents the elongated rectangular crushing plate extended out into the can's central portion as indicated by arrows. FIG. 5 illustrates the ram plate moving the precreased can toward a vertical front wall for crushing while the crushing plate is being withdrawn as indicated by arrows. FIG. 6 further illustrates the crushing plate moving through the crush cycle for maximum crush position between the two plates.

DETAILED DESCRIPTION OF THE INVENTION

Figure 1A:
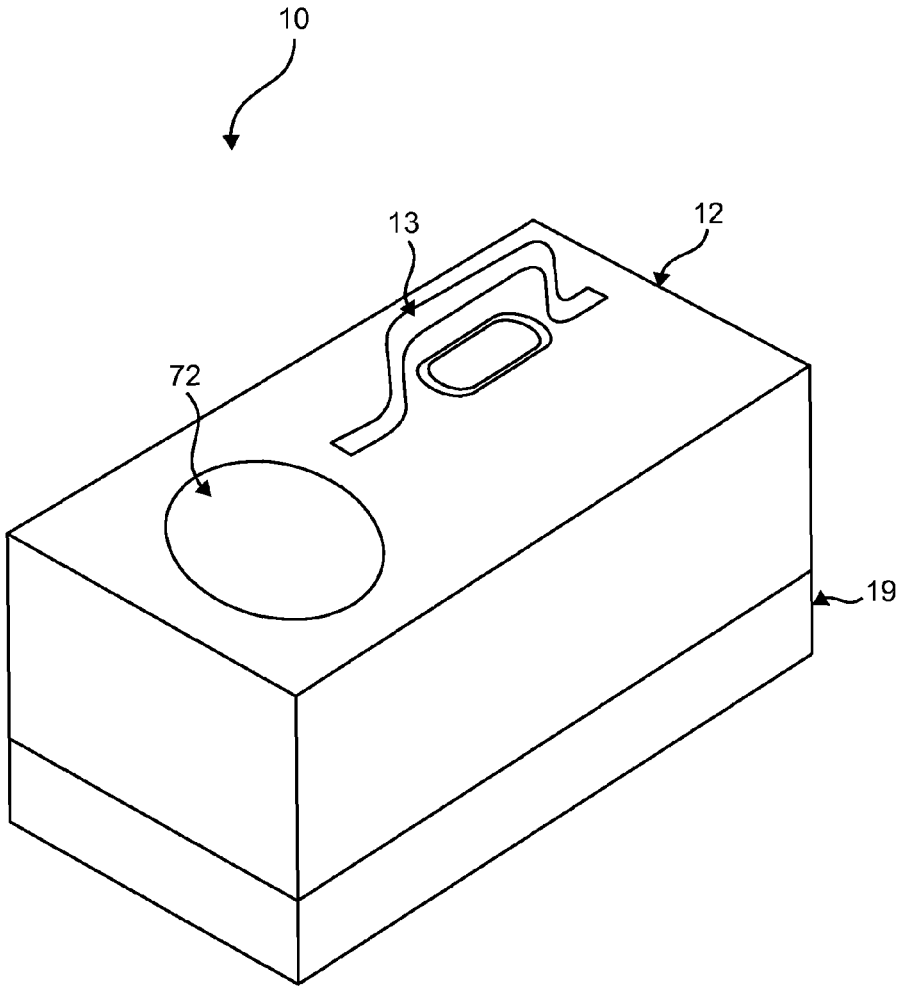
FIG. 1A is a perspective view of an exemplary embodiment of the portable electric can crusher according to the invention.
Figure 9:
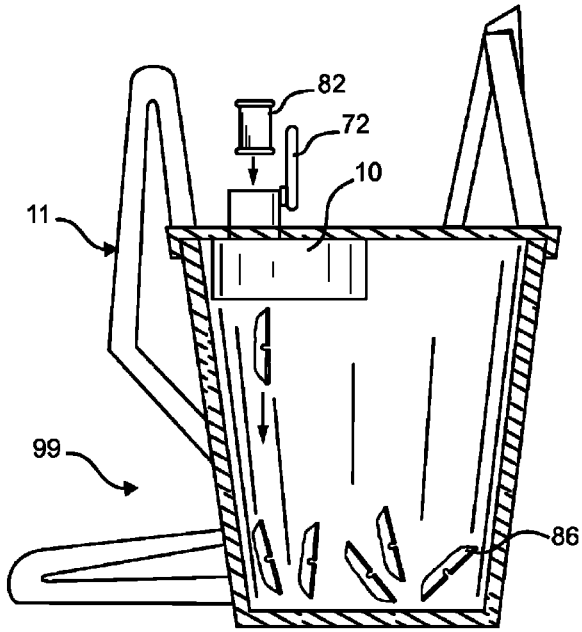
FIG. 9 is a simplistic schematic of the can crusher mounted on a receiving container such as a back pack for receiving and storing the crushed cans.

The present invention relates to a portable electric can crusher 10 (FIGS. 1A-B and FIG. 9) that can be used anywhere. FIG. 1A is a perspective view of an exemplary embodiment of the portable electric can crusher according to the invention, with a housing 12, a handle 13, a support enclosure 19 having a height from its bottom to its top of at least the same height as a crushed can, and a lid or removable cap 72, depending on the embodiment. A partially cutaway perspective view of one embodiment of the invention is presented in FIG. 1B which shows the can crusher 10 along with housing 12. The basic structural support of the can crusher 10 is the vertical wall support structure 14. The vertical wall 14 is fixed and stationary by virtue of its direct attachment to the gear box assembly or "gear box" 36 and is used as an anvil type crushing wall. Its front wall 16 has a rectangular slot 18 therethrough which accommodates entry and withdrawal of the crushing plate 26 into and from the crushing chamber 23. A ram plate 22 is drawn against the front wall 16 after the crushing plate 26 has been withdrawn. The vertical wall 14 provides structural mounting support for the various components of the dual plate, cam means and drive means. Slotted horizontal support arms 24 in cooperation with fixed guide pins 25 support the ram plate 22 and provide directed motion means of the ram plate 22 through the actions of an elongated rectangular horizontal drive plate 56 which is in structural communication with the ram plate 22 through the slotted support arms 24.

When a can is placed into the crushing chamber 23 the weight of the can rests on the U-shaped platform 28 activating the U-shaped platform pivot 32 which in turn moves the U-shaped platform switch means 34 into an activation mode for activating the crushing cycle of the apparatus. A gear box 36 provides drive means 40 through clockwise rotation of a vertical shaft to a crushing plate drive portion 44 through a drive force transfer block 48. The drive means 40 is driven by an electrical motor 38 drivably attached to gear box 36 and which is activated by the U-shaped platform switch means 34 and powered by the rechargeable battery 39 having recharging female end 100 and on/off switch 101 which are both attached to the outside of housing 12, or can be attached to support enclosure 19 depending on the embodiment. The drive force transfer block 48 is driven in clockwise rotation as indicated by the clockwise rotation arrows 42 on the drive means 40, the drive force transfer block 48 being mounted on the drive means 40. The drive force transfer block drive end 50 provides a cam motion drive to the drive slot 46 of the crushing plate drive portion 44. The drive force transfer block 48 has a first cam drive means 52 mounted on the transfer block drive end 50 and a second drive means 54 eccentrically mounted on the first cam drive means 52. The second drive means 54 functions in cooperation with a cam drive slot 46 in the horizontal drive plate 44; thus providing part of a dual plate drive system and associated drive cam means. As the ram plate 22 is driven to maximum crush contact with the can, the drive means 52 and drive slot 58 cooperate to slow the ram plate 22 forward crushing motion with motor output remaining at maximum power, thus providing greater torque. Using a newer and more powerful lithium ion battery 39 as a power source maximizes both the crushing power at the end portion of the crush stroke and the speed of each crushing cycle over a shorter distance due to the direct attachment of the gearbox assembly 36 and electric motor 38 to the vertical support structure 14. The second drive means 54 functions in cooperation with the drive slot 46 in the plate 44; thus providing the remaining cam slot drive for the dual plate drive system. The crushing plate drive portion 44 uses a rear crushing plate travel guide slot 60, and the crushing plate 26 uses rectangular slot 18 to maintain the respective portions of the crushing plate 26 in alignment during motion. The guide rod and support means 62 further supports the apparatus in relationship to the vertical wall 14. In addition, the guide and support rod 62 provides housing support through member 68. A parallel and superimposed drive plate guide slot 65 in the elongated rectangular horizontal ram plate drive plate 56 is provided which also utilizes the guide and support rod 62. A ram plate drive support contacting spacer 66 through which support guide rod 62 extends provides crushing and ram plate support through the vertical wall 14. Additional vertical housing support members 70 provide housing 12 support to the vertical wall 14, the housing support members 70 being in communication with the top portions of the vertical front wall 16.

One embodiment is provided with a feed can chute 71 having a lid 72. The lid 72 has a pivot means 74 and a lid arm means 76 which, upon the opening of lid 72, activates an electric circuit switch means 78 which places the apparatus according to this embodiment of the invention in an operational mode; and upon introduction of a can into the crushing chamber 23 resulting in the activation of the U-shaped platform switch means 34, automatically starts the can crushing cycle. Alternatively, lid 72 may be a simple removable cap without any pivot, arm or circuit switch means depending upon the particular embodiment.

Figure 8:
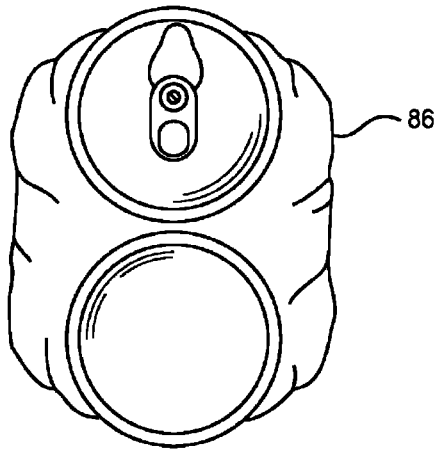
FIG. 8 presents a plane view of the can after being crushed by the apparatus according to the invention.

The housing 12 and rechargeable battery 39 are further supported, for example, by can crusher 10 support legs 80 which may be connected to the top of the support enclosure 19, and additional motor and gear box support legs (not shown) that may receive additional support from support enclosure 19. The pivotally mounted U-shaped platform and associated switch means 34 in cooperation with a possible lid 72 switch means 78 provide an portable electric can crusher with built-in safety features wherein a dual plate drive system in association with drive cam means provide the functional steps of creasing and then crushing any can into the configuration as shown in FIG. 8 with the cylindrical ends of a crushed can are in planar alignment.

The portable electric can crusher 10 of an embodiment of the present invention is utilized to laterally crush any can to a flattened, or semi-flattened configuration, for recycling purposes. The can crusher 10 may be carried by hand or by back pack. The can crusher 10 includes a vertical wall 14 having a front wall 16 with an elongated rectangular slot 18 formed therethrough. The ram plate 22 is carried toward the parallel front wall 16 by slotted support arms 24 connected at their rear ends to a drive plate 56 which is driven by the cooperation of a cam and slot means by a drive force transfer block 48 as indicated by motion arrows in FIG. 1B. The elongated rectangular crushing plate 26 is carried on the support structure 14 for forward and rearward movement relative thereto, as indicated by the arrows in FIG. 1B and is moveable forwardly and rearwardly through the elongated rectangular slot 18.

The portable electric can crusher 10 also includes a generally U-shaped platform 28 which is pivotally secured to a lower end of the vertical wall 14 and defines a can drop space 30 therewith. To drive the ram plate 22 and the crushing plate 26 forwardly and rearwardly in a sequence subsequently described, the can crusher 10 is provided with an electrical motor 38 connected to the gear box 36. The gear box 36 is drivenly connected to a cam means operatively received in cam slots 58 and 46 through the dual plate system and the drive force transfer block 48.

Figure 2A:
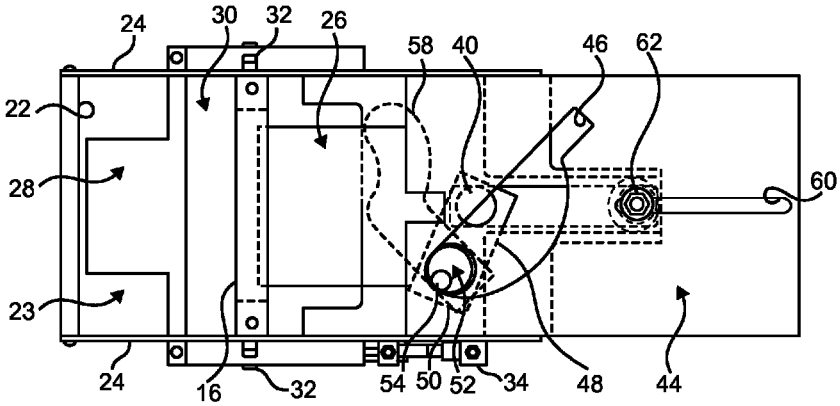
FIG. 2A is a top view of selected elements of the can crusher with the dual drive plate system and associated drive cam means in a relaxed position or starting position with the drive shaft rotation illustrated by arrows.
Figure 2B:
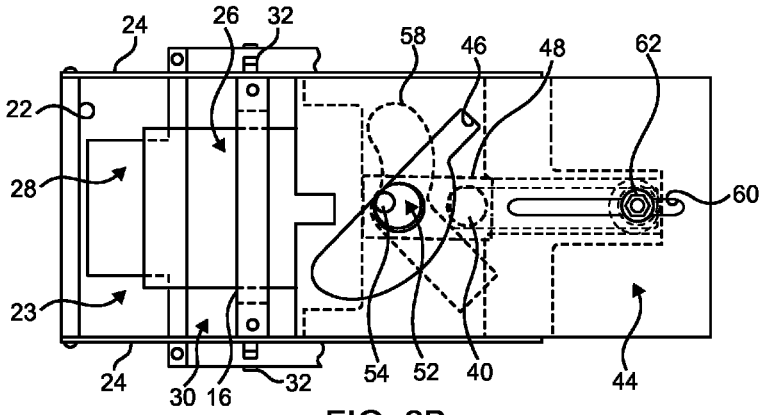
FIG. 2B is a top view of the dual plate drive system and associated drive cam means with the apparatus positioned about twenty-five percent through the crushing cycle.
Figure 2C:
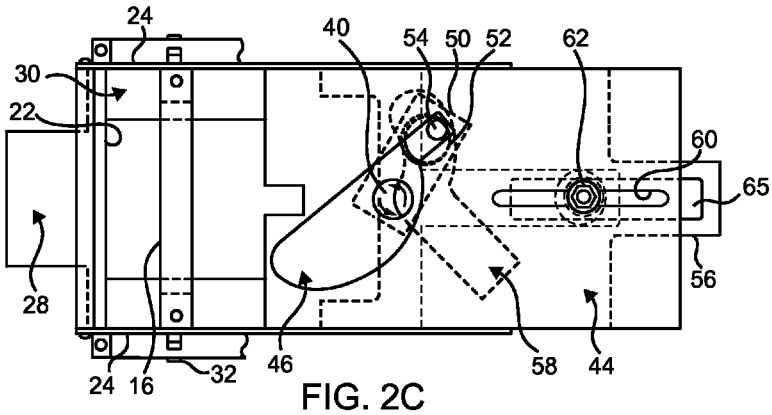
FIG. 2C is a top view of the dual plate drive system and associated drive cam means with the drive shaft rotation illustrated by arrows, rotating in a clockwise continuous fashion positioning the apparatus in a total crushing position with the continuous mode of the apparatus passing through the crushing cycle with the dual plate drive system moving away from the crushed position.
Figure 3:
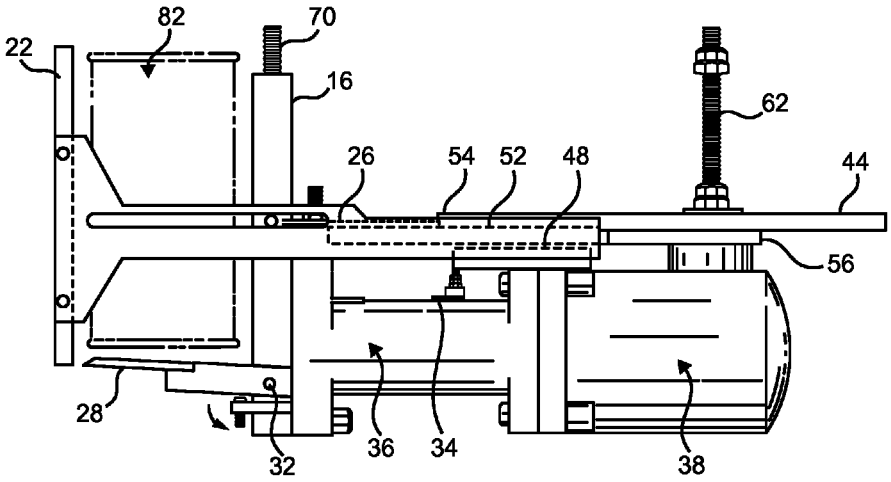
FIG. 3 is a side view of the unit according to the invention with a can in place for crushing and with the pivotal gate and switch means respective motions indicated by arrows similar to those of FIG. 1B.
Figure 4:
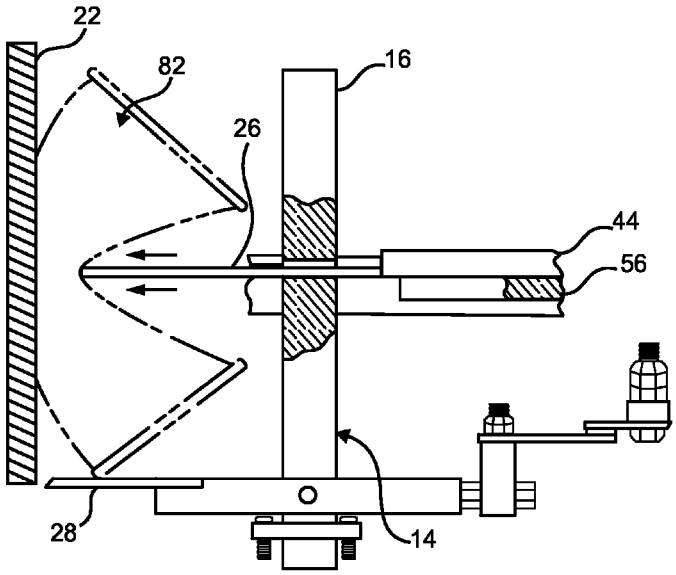
FIGS. 4, 5 and 6 are schematics of the can crushing positions of the apparatus with respective dual plate movement cycles.

The sequence of operation of the can crusher 10 is illustrated through FIGS. 2A, 2B, 2C and FIGS. 3 through 7. With the can crusher 10 in its ready to use position, FIG. 2A and FIG. 3, a can is dropped into place between the front wall 16 and ram plate 22, which defines the crushing chamber 23. The positioning of the can is such that the bottom end of the can comes to rest upon the U-shaped platform 28 with minimum applied force or the weight of the can pivoting the U-shaped platform 28 in a counterclockwise direction as indicated by the down arrow adjacent the U-shaped platform 28 in FIG. 1B, thereby closing switch means 34 and energizing the motor 38 to rotate the cam and slot means drive force transfer block 48. Initial rotation of the drive block 48 drives the crushing plate 26 forwardly through the rectangular slot 18 and the front wall 16 to thereby cause the end of the crushing plate to engage a central portion of the can and crush it against the momentarily stationary ram plate 22 as depicted in FIG. 4 and in FIG. 2B (can not shown).

Continuous rotation of the cooperative cam and slot means as driven by the drive force transfer block 48 thereby imparting a predetermined relational translation motion to the plates simultaneously moves the crushing plate 26 and the ram plate 22 in a unilateral direction to bring the partially creased or bent-over can ends into contact with the front wall 16. Continued movement toward the front wall 16 of the crushing plate 26 and the ram plate 22 withdraws the crusher plate 26 through the rectangular slot 18 in the front wall 16 and causes the ram plate 22 to laterally crush the can to its substantially flattened orientation in which the can body is laterally substantially flattened and the can ends have been rotated about 90% relative to their normal orientation. Finally, continued rotation of the cam and slot means drives the ram plate 22 toward its starting orientation, thereby releasing the laterally substantially flattened can previously held between the ram plate 22 and the front wall 16, thus permitting the can to fall through the can drop space 30 of the U-shaped platform 28 into a support enclosure 19 or back pack FIG. 9.

FIGS. 2A, 2B and 2C provide a top view of the dual plate, associated cam and slot means, as well as the drive member means in respective positions during the crushing cycle. In FIG. 2A the apparatus is at rest position. FIG. 2B shows the apparatus at an approximate 25% cycle position as can be seen by the movement of crushing plate drive portion 44 and the drive portion 44 cam drive slot 46 as well as the movement between FIG. 2A and FIG. 2B of the drive force transfer block 48; which in FIG. 2B is extended to its maximum length toward the can crushing chamber. The cam means in FIG. 2B have also traveled from one end of the cam drive slot 58 in plate 56 to a mid-portion of the slot 58 as shown in FIG. 2B. The cam drive means is positioned in both slot means in the opposite end portions of the slot means in FIG. 2C during the maximum crush cycle from its original position shown in FIG. 2A. In addition, FIGS. 2A-2C further depict the dual plate respective motions from rest, to 25% cycle, and then to 50% cycle just before the return to the rest cycle.

Figure 5:
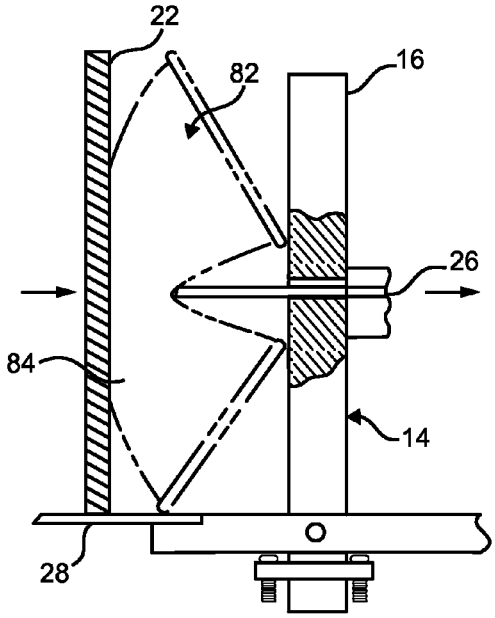
Figure 6:
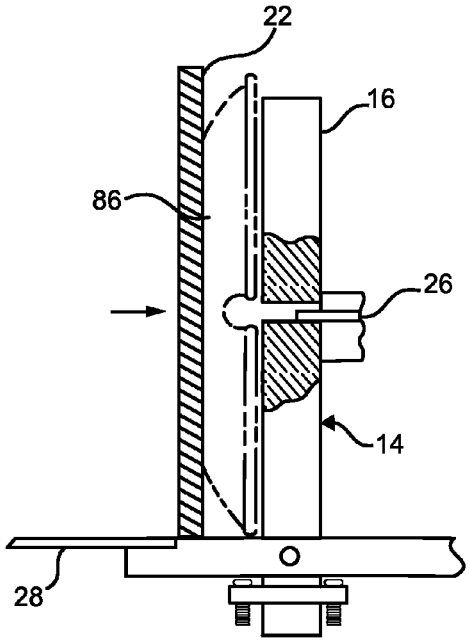
Figure 7:
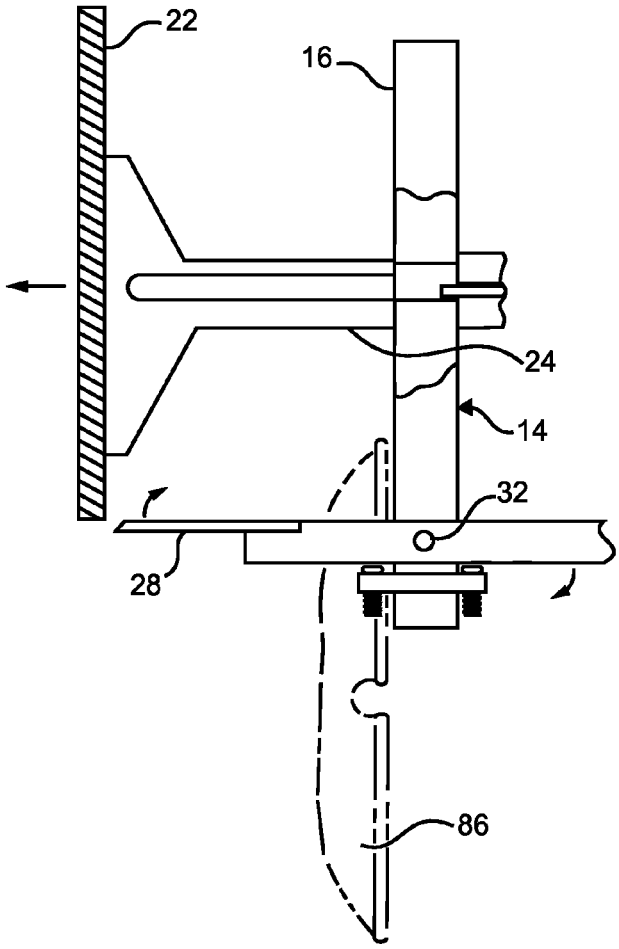
FIG. 7 illustrates the return of the crush chamber elements of the apparatus to a relaxed position while indicating the pathway of drop or removal of the crushed can from the apparatus.

In FIGS. 3-7, various cutaway side views are shown focusing primarily on the can crushing chamber 23. In FIG. 3 a side view of the can crushing chamber 23 is shown with a can being placed in position for crushing and the respective motion of the can, through manual force or its weight action on U-shaped platform 28, U-shaped platform pivot 32 and switch means 34. FIG. 3 shows the respective dual plate cam slot means in the at rest position just before activation by the actions of switch means 34. FIG. 4 shows the apparatus during one portion of the cycle where the crushing plate 26 is extending into the can to approximate maximum extended position. In FIG. 5 the crushing plate 26 is in a withdrawing mode as indicated by the arrow, while the ram plate 22 is being moved toward the front wall 16 thus forcing the partially crushed can 84 with its cylindrical end portions tipped by about 90% toward the vertical for final crushing. FIG. 6 shows the ram plate 22 in the maximum crushing position as indicated by the arrow where the ram plate 22 has moved to its closest proximity to the front wall 16. The can as shown in FIG. 6 has been crushed to its minimum dimension by the apparatus. In FIG. 7 the apparatus has moved toward the end of the full cycle wherein the ram plate 22 is moving to its at rest position as indicated by the arrow, the U-shaped platform 28 is returning to its at rest position thus through pivot arm means is moving toward a switch means disconnect while the maximum crushed can is falling through the can drop space 30. The crushed can configuration is illustrated in FIG. 8 while in FIG. 9 a simplistic schematic of the can crusher mounted on a back pack 99 for the crushed cans as shown with a can 82 in position to be received by the can crusher through open lid 72 and with a crushed can 86 being released into the back pack 99 having straps 11 for carrying.

Figure 1B:
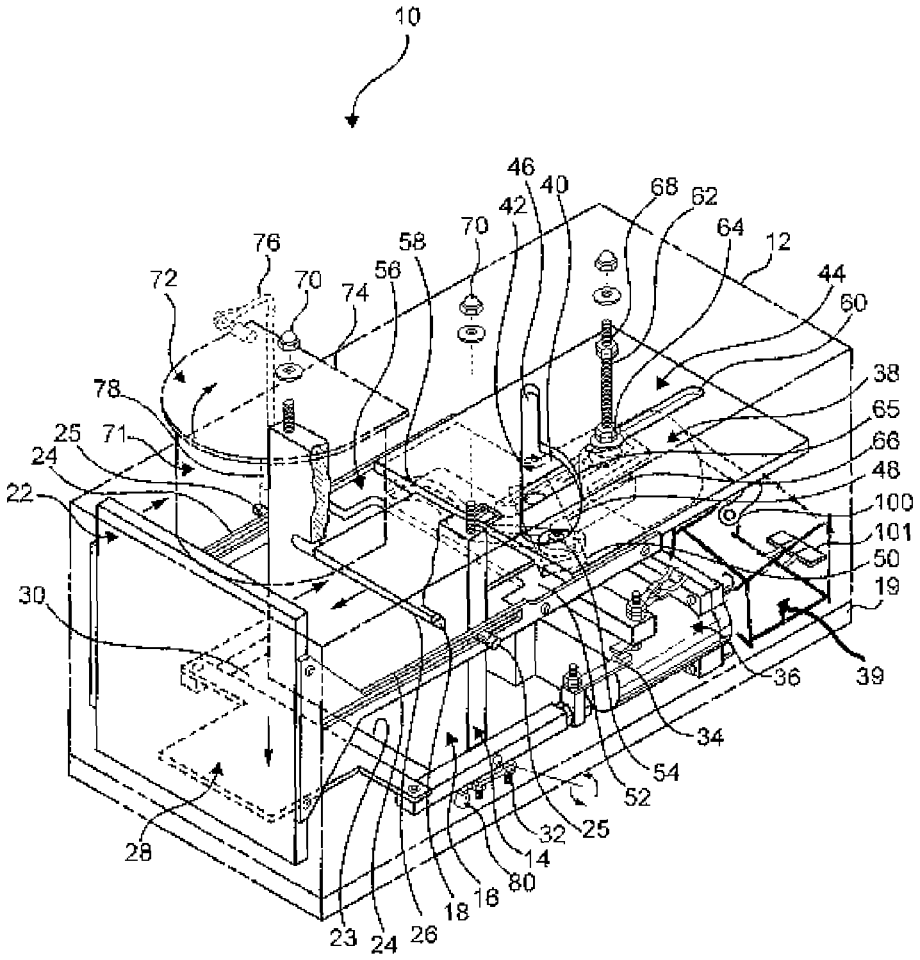
FIG. 1B is a partially cutaway perspective view of a possible embodiment of the portable electric can crusher according to the invention. Movement of the relative elements including the dual drive plate system of the apparatus is shown by arrows.

The apparatus according to at least one embodiment of the present invention incorporates a number of safety features to help avoid injury to the operator. In one embodiment, the apparatus could use a low horsepower motor that does not have enough force and power to seriously hurt a person's hand in the apparatus as shown. The apparatus may take between 5 and 10 seconds to cycle, and less or more, depending upon the application by varying the power of the battery and/or the electric motor. In a particularly "safe" embodiment, if an individual managed to place a portion of his hand into the apparatus and activate the cycle, the individual has a reasonable amount of time to remove the hand from the apparatus before the crushing stroke. The embodiment of the invention as shown in FIG. 1B does not allow the apparatus to operate with the lid open. In addition, for home use, the can crusher could have an elongated rectangular crushing plate 26 of a thickness of about 1/16" made from example, polypropylene which is rigid enough to fold the side of the aluminum can but limber enough not to seriously injure a person's fingers. In addition, the apparatus could also incorporate a relay which would reverse the motor direction at approximately 10% over the force necessary to fold a can. The unit would then open back up and shut off until the foreign object that was restricting the unit motion is cleared and the reset button depressed. The final gap of the can crusher according to the invention closes up to about 3/8" which is about the same as a human finger thus avoiding serious injury to anyone's finger inadvertently placed into the crusher chamber, now matter how powerful the battery or electric motor for that embodiment.

Environmental needs as well as raw material recycle economics have placed a substantial demand for collecting cans. Unfortunately a twenty gallon volume of uncompressed cans, i.e., a large trash bag filled with cans, weighs only about four to five pounds. The recycle economics pay for these cans on a "per pound" basis. Thus, the recycler, collector, or any user would benefit substantially from the use of a can crusher such as provided in the invention wherein the same twenty gallon volume would weigh from about thirty to forty pounds not only presenting a temporary storage and transport mode for these cans but also providing the recycler with a pre-crushed volume of higher value resulting from the increased crushing frequency at the point of collection. By collapsing first the side walls and then the ends of cans, rather than collapsing the two simultaneously, provides for much greater uniformity for automated handling after delivery to the end recycler. But more importantly, the power or strength requirements by the apparatus according to the invention are increased because of the availability of high power batteries available today.

The foregoing detailed description is to be clearly understood as given by way of illustration and example only, the spirit and the scope of this invention being limited solely by the appended claims.

What is claimed is:

1. A portable electric can crusher to laterally crush cans, comprising:

a support structure having a rigid vertical wall with an elongated rectangular slot formed therethrough attached horizontally to a motor gearbox assembly;

an elongated rectangular crushing plate having a crushing plate drive portion carried on the support structure for back and forth movement relative thereto through the elongated rectangular slot in the support structure vertical wall;

a ram plate carried by support arms against the vertical wall, said support arms being connected to a drive plate, the ram plate being movable with said drive plate toward and away from the vertical wall;

a back pack support enclosure secured underneath the support structure vertical wall, the enclosure defining a crushed can drop space for storage therein and removal therefrom;

a switch and a rechargeable battery attached atop said support enclosure for powering a motor;

a can crushing chamber defined by the space within the vertical wall and ram plate above the support enclosure;

a housing mounted to the support structure vertical wall, said housing having a handle for ease of transport;

said drive plate and said crushing plate drive portion comprising dual drive plates having dual drive cam and dual slot means for moving the dual plates in a predetermined relation translation motion wherein the crushing plate is moved to crush the middle of a can in the crushing chamber and the ram plate is moved to crush the ends of a can in the crushing chamber; and said motor gearbox assembly connected horizontally to said motor which is drivingly connected to said dual drive cam and dual slot means by a force transfer block for operating said dual drive plates cooperatively for imparting said predetermined relation translation motion of the plates in response to motion of said force transfer block wherein cans can be repetitively crushed in said crushing chamber.

2. The can crusher according to claim 1 wherein the dual drive plates are parallel with overlapping guide slots and common guide rod support means.

3. The can crusher according to claim 1 wherein the dual drive cam and dual slot means provide an eccentrical motion to the dual drive plates upon motion of the drive force transfer block.

4. The can crusher according to claim 3 wherein the eccentrically driven dual drive plates provide changes in horizontal motion speed of the ram plate as the ram plate approaches maximum crush cycle.

5. The can crusher according to claim 4 wherein the ram plate speed is slowed upon approaching maximum crush cycle while power from the motor and gear box assembly remains constant.

6. The can crusher according to claim 1 wherein the dual drive cam and dual slot means translate the force transfer block circular motion to the dual drive plates substantially to unilateral motion of the plates.

7. The can crusher according to claim 1 wherein the can crushing chamber has a safety lid means pivotally mounted on a vertical can chute above the crushing chamber, the safety lid having a switch means which allow operation of the can crusher when the safety lid means is closed.

8. The can crusher according to claim 7 wherein the can chute and crushing chamber vertically position the can in the chamber.

9. The can crusher according to claim 8 wherein the vertically positioned can in the crushing chamber activates the crushing cycle and the crushing plate through a U-shaped support structure pivot, the crushing plate travel allowing the can to be crushed along a mid portion in an end-to-end partial fold position.

10. The can crusher according to claim 7 wherein the chute is comprised of an elongated tube means for receiving multiple cans, the chute being mounted at an angle to the axis of the crusher chamber allowing entry of one can per cycle into the crushing chamber.

* * * * *